US005566417A

United States Patent [19]

Hsieh

[11] Patent Number: 5,566,417

[45] Date of Patent: Oct. 22, 1996

[54] TWISTABLE WRING MOP WITH DUAL LOCKING MEMBERS

[76] Inventor: Stephen Hsieh, 3 Winchester, Irvine, Calif. 92720

[21] Appl. No.: 380,376

[22] Filed: Jan. 30, 1995

[51] Int. Cl.[6] ..... A47L 13/142

[52] U.S. Cl. ..... 15/120.2; 15/229.1; 15/120.1

[58] Field of Search ..... 15/120.2, 120.1, 15/119.1, 228, 229.1, 229.2, 229.6

[56] References Cited

U.S. PATENT DOCUMENTS

| | | | |
|---|---|---|---|
| Re. 15,274 | 1/1922 | Kenner | 15/120.2 |
| 728,332 | 5/1903 | Thomas | 15/120.1 |
| 1,046,829 | 12/1912 | McCoy | 15/120.1 |
| 1,514,051 | 11/1924 | Jumonville | 15/120.2 |
| 1,520,500 | 12/1924 | Jumonville | 15/120.2 |
| 1,700,136 | 1/1929 | Leidgen | 15/120.2 |
| 1,760,695 | 5/1930 | Hertzberg | 15/120.2 |
| 1,870,845 | 8/1932 | Goldfinger | 15/120.2 |
| 1,937,141 | 11/1933 | Carlson | 15/120.2 |
| 2,495,846 | 1/1950 | Johnson | 15/120.2 |
| 2,677,838 | 5/1954 | Jouban | 15/120.2 |
| 4,130,910 | 12/1978 | Raven | 15/120.2 |
| 4,479,278 | 10/1984 | Heinonen | 15/120.2 |

*Primary Examiner*—Gary K. Graham
*Attorney, Agent, or Firm*—Raymond Sun

[57] ABSTRACT

A mop comprising a shaft, a handle portion attached to the upper portion of the shaft, a base non-rotatably secured to the lower portion of the shaft, and an outer tube slidably positioned along the shaft. A plurality of mop strands have their upper ends secured to a first annular tie member and their lower ends secured to a second annular tie member. The upper ends of the mop strands and the first annular tie member are secured to the outer tube, while the lower ends of the mop strands and the second annular tie member are secured to the base. The mop further comprises first and second locking members extending through openings in the outer tube. The first and second locking members are adapted to engage the shaft to prevent movement of the outer tube relative to the shaft.

15 Claims, 4 Drawing Sheets

TWISTABLE WRING MOP WITH DUAL LOCKING MEMBERS

BACKGROUND OF THE INVENTION

1. Field of the Invention

The present invention relates to a mop, and in particular, a mop having mop strands which may be wrung dry by twisting the mop strands about an internal shaft, and which is provided with locking mechanisms for holding the mop strands in different configurations for use in different applications.

2. Description of the Related Art

Conventional mops are typically provided with mop strands having lower ends connected to a bottom or base of an internal shaft and an opposing second end connected to a tubular member or sleeve that may be rotatably slid along the length of the internal shaft. The mop strands may be wrung dry by extending the length of the mop strands and twisting the tubular member, and the upper ends of the mop strands, about the internal shaft. This twisting action is typically accomplished by using one hand to grip a handle provided on the internal shaft, and using the other hand to grip and twist the tubular member, so that the user need not physically grip the mop strands when wringing them dry. Examples of such mops are shown and described in U.S. Reissue No. 15,274 (Kenner), and U.S. Pat. Nos. 1,700,136 (Leidgen), 1,760,695 (Hertzberg), 1,870,845 (Goldfinger), 1,937,141 (Carlson), 4,479,278 (Heinonen) and 4,130,910 (Raven).

However, each of these conventional mops require the user to hold the tubular member in the twisted position to effect complete wringing. This makes the mops inconvenient to use and does not result in effectively drying the mop strands.

Attempts have been made to secure or hold the mop strands in the twisted position to ensure that the mop strands have been wrung sufficiently dry. One example is shown and described in U.S. Pat. No. 2,495,846 (Johnson), in which a ratchet wheel and corresponding pawl are provided in a box-like head at the lower end of the internal shaft to prevent any reverse rotation during the wringing operation. A pawl plate must be swung to a certain position to release the control of the ratchet wheel. Thus, the operation of the ratchet wheel is not simple. Further, the construction of the ratchet wheel and its corresponding pawl and pawl plate is complex. Another example is shown and described in U.S. Pat. No. 2,677,838 (Jouban), in which a nut may be threaded into a collar to stretch the mop strands and to twist them about the handle or internal shaft to wring them dry. However, this operation is not convenient because it requires the user to carefully insert the nut into the collar for the threaded engagement. For example, to effectuate the threaded engagement with the mop strands on the ground, the user must bend over and stay in the bent-over position until the nut has been completely threaded into the collar. This would be troublesome for individuals with back problems. On the other hand, lifting up the mop strands and turning them in mid-air to effectuate the threaded engagement may result in water being flung into the environment, which is also undesirable. U.S. Pat. Nos. 1,514,051 (Jumonville) and 1,520,500 (Jumonville) illustrate a further example, in which a ratchet button extending through an outside tubular member or sleeve is provided with shoulders for engaging ratchets provided along an upper portion of a shaft.

One drawback with each of the above-described conventional mops is that they are not effective in cleaning a large variety of objects or surfaces. For example, the mop strands of these conventional mops are typically adapted to assume one of two positions: (1) a twisted position to wring the strands dry, as illustrated, for example, in FIG. 2 of U.S. Pat. No. 1,760,695 to Hertzberg, and (2) a completely relaxed position in which the mop strands hang loosely from the base of the mop when the mop is lifted above the ground, as illustrated, for example, in FIG. 3 of U.S. Pat. No. 1,760,695 to Hertzberg. This second loose configuration of the mop strands is not effective in applying sufficient pressure on certain hard spots on objects or surfaces to clean thse spots effectively. In this regard, these conventional mops do not have the capability of allowing the outside tubular member to be locked at any desired position along the shaft to change the shape or configuration of the mop strands or mop head for use in different cleaning applications. This is a desirable feature since differently-configured mop strands will allow the mop to be used with a number of different applications and in cleaning a larger variety of objects and surfaces. For example, if the mop strands or mop head were configured as a tight ball, the mop could be used to apply pressure more effectively on hard spots to clean windows, automobile tires and wheel rims, automobile rooftops, and other items which a loosely-hanging group of mop strands are not effective in cleaning. In this regard, it appears that the cooperating ratchet button and ratchets in the mop of U.S. Pat. Nos. 1,514,051 (Jumonville) and 1,520,500 (Jumonville) can only be engaged along an upper portion of the shaft (see FIG. 1), so that the outside tubular member cannot be locked at any desired location along the shaft.

Thus, there remains a need for a mop that is light in weight, simple and durable in construction, and convenient to use. In particular, there remains a need for a mop that allows the user to effectively wring dry the mop strands with minimal effort, which allows the user to conveniently change the configuration of the mop head or strands for use in cleaning different objects and surfaces, and which may be operated quickly and easily.

SUMMARY OF THE INVENTION

The objects of the present invention may be achieved by providing a mop comprising a shaft, a handle portion attached to the upper portion of the shaft, a base non-rotatably secured to the lower portion of the shaft, and an outer tube slidably positioned along the shaft. The outer tube comprises a first opening, a second opening, and a flared bottom portion, the flared bottom portion having a circumferential dimension that is largest at its lower edge. The mop further comprises a plurality of mop strands having upper ends secured to a first annular tie member and lower ends secured to a second annular tie member. The first annular tie member has a circumferential dimension that is smaller than the largest circumferential diameter of the flared bottom portion so that the upper ends of the mop strands and the first annular tie member are engaged by the flared bottom portion. The lower ends of the mop strands and the second annular tie member are secured to the base.

The mop further comprises a first locking member extending through the first opening of the outer tube, the first locking member comprising a lower concave surface terminating at two outer edges and an upper convex surface also terminating at two outer edges, the lower concave surface having substantially the same curvature as the outer surface of the shaft and the upper convex surface having substantially the same curvature as the inside surface of the outer tube. The first locking member is adapted to assume two positions with respect to the shaft. In In a first position, the lower concave surface of the first locking member substantially corresponds with the curvature of the curved outer surface of the shaft to allow relative movement between the outer tube and the shaft. In a second position, the first locking member has been rotated by ninety degrees so that the outer edges of the lower concave surface frictionally engage the shaft, and simultaneously, the outer edges of the upper convex surface frictionally engage the inside surface of the outer tube, to prevent relative movement between the outer tube and the shaft. The mop further comprises a second locking member extending through the second opening of the outer tube, the second locking member comprising a lower concave surface having substantially the same curvature as the shaft. The second locking member may be pushed against the shaft to prevent relative movement between the outer tube and the shaft. In its operation, the second locking member is adapted for temporarily holding the outer tube in a desired position along the shaft while the first locking member is rotated to the second position to frictionally engage the shaft.

In the mop according to the present invention, the first locking member further comprises a hollow button comprising opposing openings adapted to receive a locking ring. The locking ring is itself adapted to be gripped by a user for rotating the first locking member. The second locking member further comprises a button adapted to be pressed by a user in use. The first and second locking members are preferably positioned substantially opposite each other along the outer tube.

The mop according to the present invention further comprises a bore provided in the base, and with the bore comprising a plurality of threads. The mop further comprises a locking screw having a plurality of threads and an annular flange. The lower ends of the mop strands and the second annular tie member are adapted to be secured inside the bore by engaging the threads of the locking screw and the bore and having the annular flange support the lower ends of the mop strands and the second annular tie member.

The first and second locking members according to the present invention may be operated in combination to lock the outer tube at a desired position against the shaft. The outer tube may be advanced and twisted (if desired) with respect to the shaft to a desired position, and the second locking member may be pressed by one hand of the user to temporarily hold the outer tube at the desired position while the other hand rotates the first locking member to lock the outer tube at that desired location. Thus, the first and second locking members can be easily manipulated to lock the outer tube at a desired position along the shaft to allow the mop strands to assume a variety of configurations so that the mop of the present invention can be used in cleaning a variety of objects and surfaces. The locking members are durable, simple in construction, and are easy to operate.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 3:
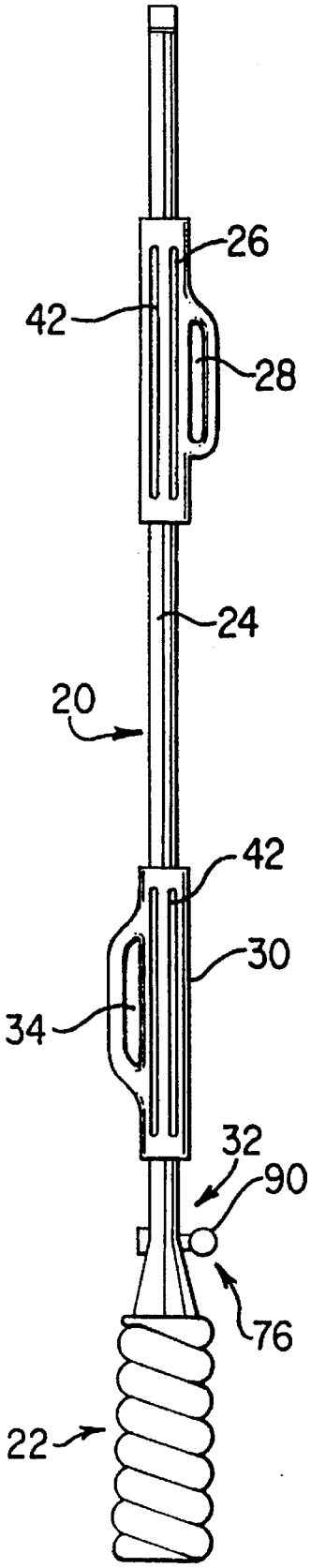
FIG. 3 is a side elavational view of the mop of FIG. 1 with the mop strands or mop head locked in a twisted configuration to wring the mop strands dry.
Figure 2:
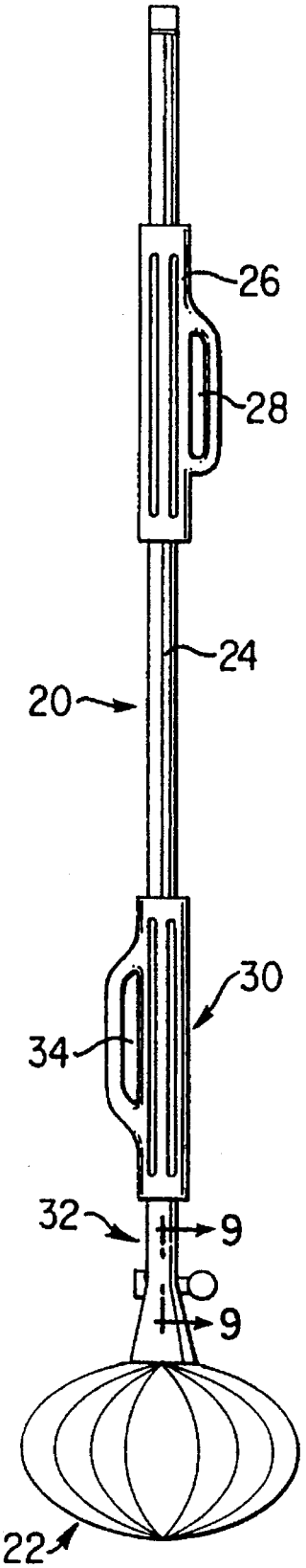
FIG. 2 is a side elavational view of the mop of FIG. 1 with the mop strands or mop head configured as a ball for use in a variety of other cleaning applications.
Figure 1:
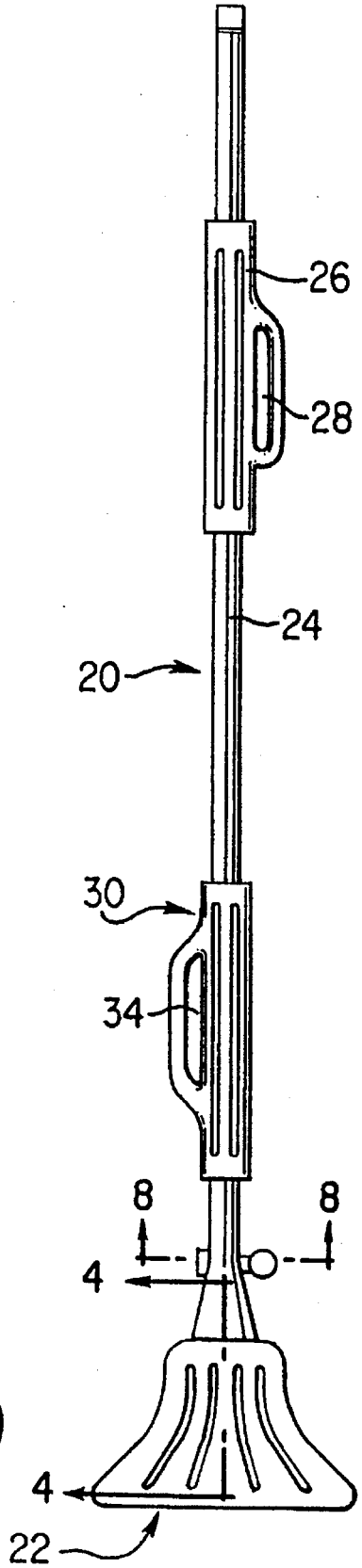
FIG. 1 is a side elavational view of a mop in accordance with an exemplary embodiment of the present invention shown in position for use in mopping or cleaning a floor.

The mop 20 according to the present invention may have its mop strands or mop head 22 configured in one of several configurations to allow for use in cleaning different surfaces and objects. For example, FIG. 1 illustrates the mop strands 22 in a loose and hanging position in which they are effective in spreading across a large surface area, but in which they are not effective in cleaning specific spots. FIG. 2 illustrates the mop strands 22 in a bundled or ball-shaped configuration in which the mop head 22 may be used to clean particular hard spots at all elevations on or above the ground, including dirt spots on floors, windows, the roof of an automobile, automobile wheel rims, shelves, and a variety of other objects. FIG. 3 illustrates the mop strands 22 locked in a twisted position to be wrung dry of any fluids.

More specifically, the mop 20 comprises an elongate cylindrically-shaped shaft 24 having a handle portion 26 secured at an upper portion thereof. The shaft 24 is preferably hollow and made of a lightweight material such as steel, plastic or aluminum, although other materials may be used without departing from the spirit and scope of the present invention. The handle portion 26 may be attached to the shaft 24 by screws, rivets, or glue, and comprises an upper handle 28 for allowing the user to grip the mop 20 during use.

The mop 20 further comprises an outer tube 30 which is slidably positioned along the length of the shaft 24 below the handle portion 26. A flared bottom portion 32 is attached or otherwise provided integrally at the lower portion of the outer tube 30. A lower handle 34 is provided along the outer tube 30 for allowing the user to grip and manipulate the outer tube 30.

Figure 5:
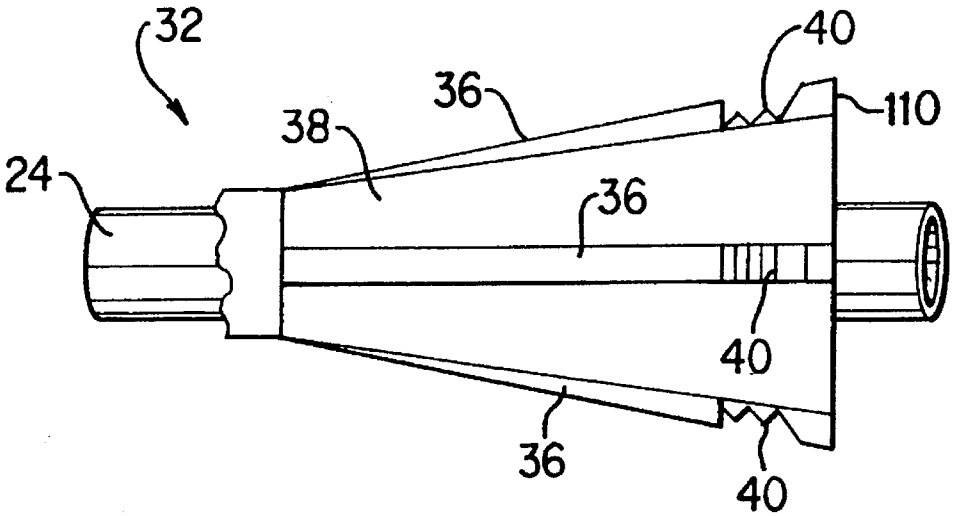
FIG. 5 is a side elevational view of the flared bottom portion of the outer tube of the mop of FIG. 1.
Figure 7:
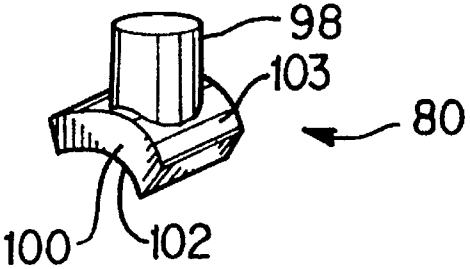
FIG. 7 is perspective view of a second locking mechanism used in the mop of FIG. 1 to secure the mop strands at a desired configuration.
Figure 6:
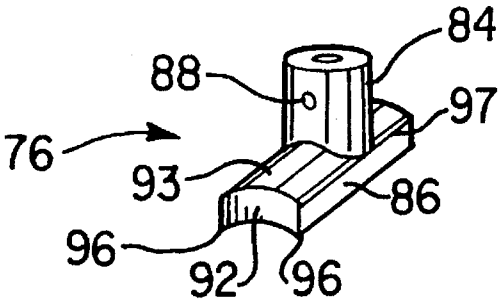
FIG. 6 is perspective view of a first locking mechanism used in the mop of FIG. 1 to secure the mop strands at a desired configuration.
Figure 9A:
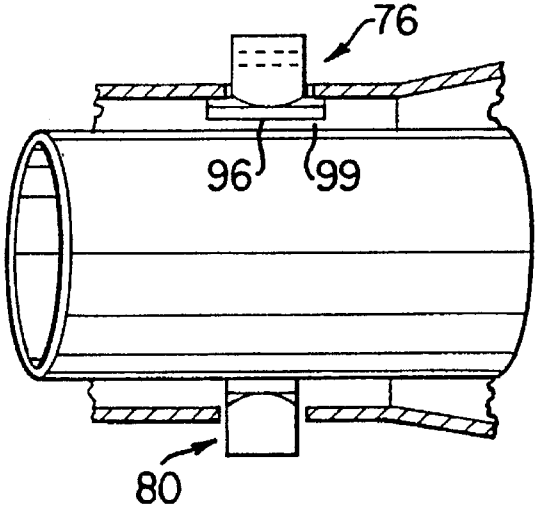
FIGS. 9A and 9B are vertical cross-sectional views taken along line 9—9 of FIG. 2.
Figure 9B:
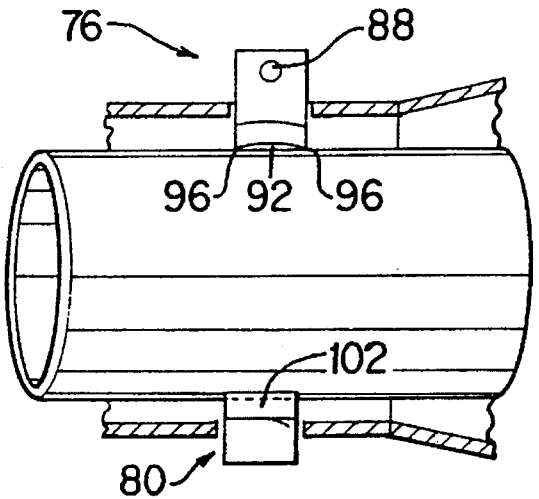
Figure 8A:
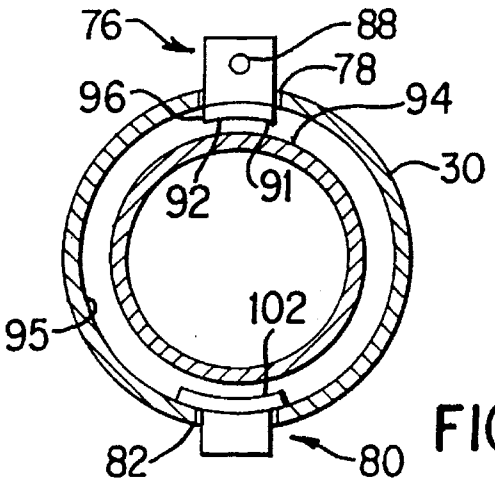
FIGS. 8A and 8B are horizontal cross-sectional views taken along line 8—8 of FIG. 1.
Figure 8B:
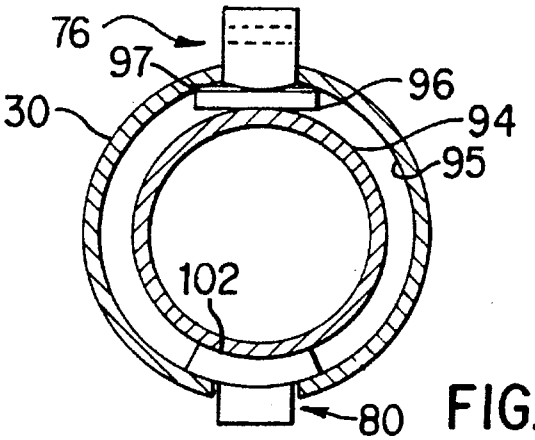

Referring to FIG. 5, the flared bottom portion 32 has its walls flared radially outwardly from the outer tube 30 in the downward direction, so that its bottom-most edge has the largest circumferential dimension. A plurality of vertical ribs 36 are provided along the outer surface 38 of the flared bottom portion 32. Each rib 36 is also provided with a plurality of serrations or teeth 40 adapted for gripping or holding the upper ends of the mop strands 22, as explained in greater detail hereinbelow. As shown in FIG. 5, the teeth 40 are preferably recessed from the outside surface of the rib 36, although the teeth 40 may also be provided flush with the outside surface of the rib 36 without departing from the spirit and scope of the present invention. At least three ribs 36 are preferably provided on the flared bottom portion 32, and any greater number of ribs 36 may also be utilized without departing from the spirit and scope of the present invention. Likewise, at least one tooth 40 is preferably provided on each rib 36, and any greater number of teeth 40 may also be utilized without departing from the spirit and scope of the present invention. The interior of the outer tube 30 and its flared bottom portion 32 are preferably hollow.

The handle portion 26, the outer tube 30 and the flared bottom portion 32 are preferably made from a lightweight material such as PVC, plastics or aluminum. Grooves 42 may be molded or otherwise provided on the handle portion 26 and outer tube 30 to enhance the user's grip.

Figure 4:
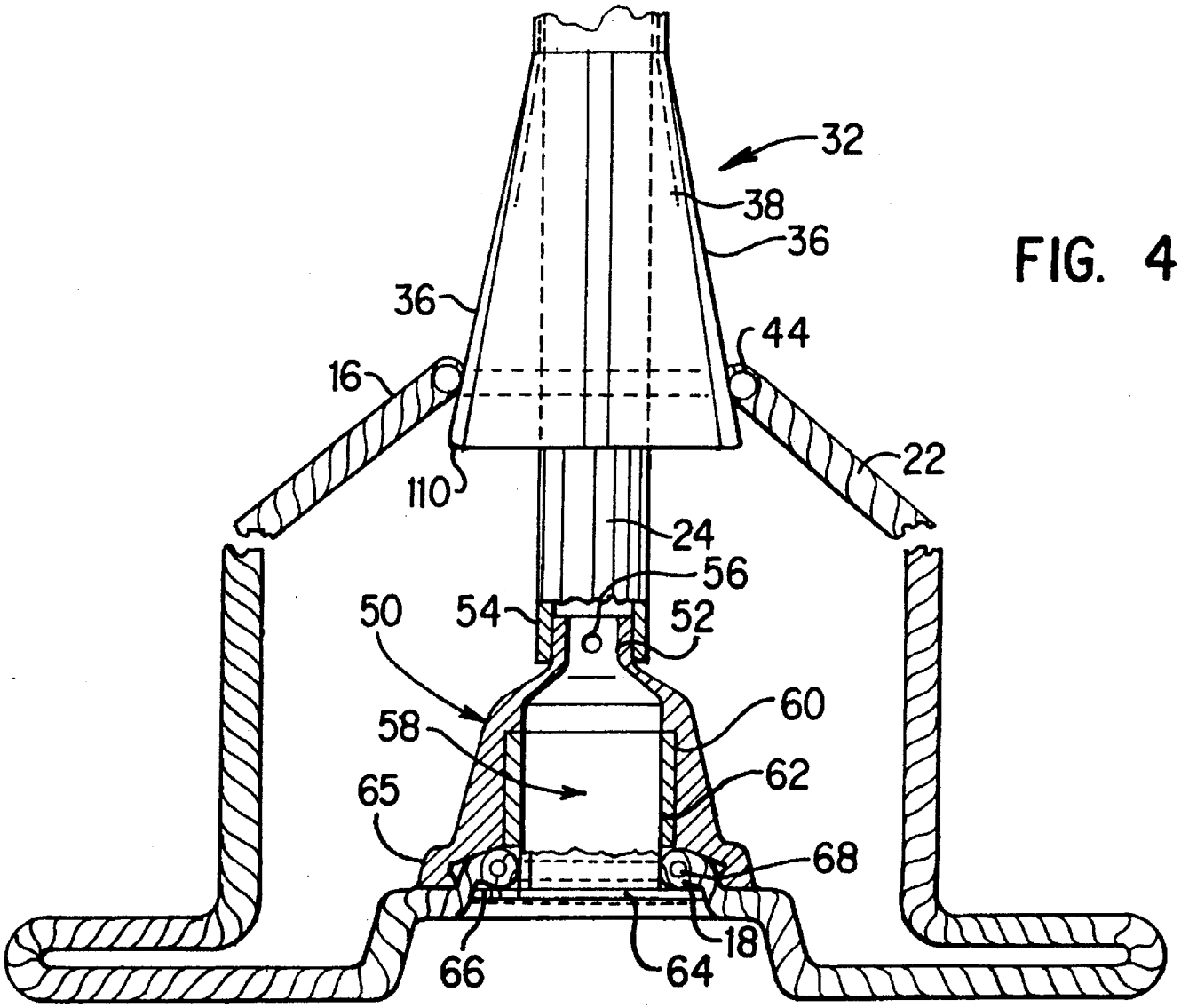
FIG. 4 is a vertical cross-sectional view taken along lines 4—4 of FIG. 1.

Referring to FIG. 4, the upper ends 16 of the mop strands 22 are held or supported at the flared bottom portion 32 with the aid of a first annular tie member 44, which has a circumferential dimension smaller than the largest circumferential dimension of the flared bottom portion 32. The upper ends 16 of the strands 22 pass under the tie member 44 and over it, and are stitched or otherwise attached together to form a sleeve for housing the tie member 44. In this manner, the annular tie member 44 and the attached upper ends 16 of the mop strands 22 can only slide upwardly along the outer tube 30 and the flared bottom portion 32, and cannot slide downwardly past the bottom-most edge of the flared bottom portion 32, which has the largest circumferential dimension. When the upper ends 16 of the strands 22 and the tie member 44 slide downwardly along the flared bottom portion 32, their downward progress will be impeded by the ribs 36 and teeth 40 which grip the upper ends 16 of the strands 22 to prevent the strands 22 from moving or spinning.

The mop 20 further comprises a base 50 attached to the bottom end of the shaft 24. Specifically, the base 50 comprises a hollow neck 52 which may be secured to the bottom 54 of the shaft 24 by inserting a pin 56 through complementary holes provided in the bottom 54 of the shaft 24 and the neck 52. Alternatively, the shaft 24 may be secured to the neck 52 by gluing, welding, threaded engagement, screws, rivets or other conventional attachment mechanisms. In any case, the base 50 is preferably unrotatable with respect to the shaft 24.

The base 50 is further configured as a cup which opens towards the bottom so as to define an internal bore 58. Threads 60 are provided along the upper portion of the internal bore 58 and are adapted for threadably engaging the threads 62 that are provided on a large locking screw 64. The base 50 and the bore 58 define an annular shoulder 65 at the lower portion of the bore 58. The locking screw 64 further comprises an annular flange 66 which extends radially at the bottom of the locking screw 64. A recessed handle bar (not shown) may be provided in the center of the locking screw 64 to allow the user to grip the locking screw 64 when screwing it onto the base 50.

The lower ends 18 of the mop strands 22 are held or supported at the base 50 with the aid of a second annular tie member 68, which has a circumferential dimension smaller than the circumferential dimension of the annular flange 66. The lower ends 18 of the strands 22 pass under the tie member 68 and over it, and are stitched or otherwise attached together to form a sleeve for housing the tie member 68. In this manner, the annular tie member 68 and the attached ends of the mop strands 22 are placed inside the bore 58 at its annular shoulder 65, below the threads 60, and the locking screw 64 is screwed into the bore 58 by engaging the threads 60 and 62 to hold the lower ends 18 of the mop strands 22 securely within the base 50. In this position, the annular flange 66 supports the tie member 68 and the lower ends 18 of the strands 22 inside the bore 58. Since the circumferential dimension of the annular flange 66 is wider than the circumferential dimension of the tie member 68, the tie member 68 will not become detached from the base 50 and its locking screw 64.

When provided in this manner, the mop strands 22 may be easily removed and replaced with new mop strands 22. To detach the mop strands 22, the locking screw 64 is unscrewed to release the lower ends 18 of the mop strands 22 and the second annular tie member 68. The shaft 24, outer tube 30 and flared bottom portion 32 are then pushed downwardly to allow the upper ends 16 of the mop strands 22 and the first tie member 44 to disengage from the teeth 40 to be removed from the flared bottom portion 32.

To fix a new mop head or mop strands 22, the upper end of the shaft 24 is pushed through the upper ends 16 of the strands 22 and the first annular tie member 44 so that they settle on the flared bottom portion 32 and engage the teeth 40 of the ribs 36. The lower ends 18 of the strands 22 and the second annular tie member 68 are then placed in the lower portion of the bore 58 at about the annular shoulder 65 and secured thereat by inserting the locking screw 64 through the annular opening defined by the tie member 68 and screwing the locking screw 64 into the base 50.

The mop 20 according to the present invention further comprises two locking members which may be used to lock the outer tube 30 and its flared bottom portion 32 at any desired position along the length of the shaft 24. Referring now to FIGS. 6–9, a first locking member 76 is insertable through and adapted to be seated in a first opening 78 provided along the outer tube 30, and a second locking member 80 is insertable through and adapted to be seated-in a second opening 82 provided also along the outer tube 30.

The first locking member 76 comprises a hollow button 84 integrally formed with an arcuate base 86. Opposing openings 88 are provided in the button 84 for receiving a metal ring 90 to allow the user to twist the first locking member 76 (see FIG. 3). The arcuate base 86 is configured such that its lower concave surface 92 is adapted to have substantially the same curvature and configuration as the complementary curved outer surface 94 of the shaft 24 (see FIG. 8A). The arcuate base 86 is further configured such that its upper convex surface 93 is adapted to have substantially the same curvature and configuration as the complementary curved inside surface 95 of the outer tube 30. The lower concave surface 92 terminates at two outer edges 96 and the upper convex surface 93 terminates at two outer edges 97. In operation, when the first locking member 76 is in a first position shown in FIGS. 8A and 9A, the curvature of its lower concave surface 92 substantially corresponds to the curvature of the curved outer surface 94 of shaft 24 and defines a gap 91, so that the outer tube 30 may be freely slid along the shaft 24. However, if the first locking member 76 is twisted by about ninety degrees in either direction to a second position shown in FIGS. 8B and 9B, the outer edges 96 of the lower concave surface 92 frictionally engage the surface 94 of the shaft 24, and simultaneously, the outer edges 97 of the upper concave surface 93 frictionally engage the surface 95 of the outer tube 30. This pushes the shaft 24 against the second locking member 80 and prevents relative movement between the outer tube 30 and the shaft 24.

The second locking member 80 also comprises a button 98 and an arcuate base 100. The arcuate base 100 is also configured such that its lower concave surface 102 is adapted to have substantially the same curvature and configuration as the surface 94 of the shaft 24 (see FIG. 8A). The arcuate base 100 is also configured such that its upper convex surface 103 is adapted to have substantially the same curvature and configuration as the inside surface 95 of the outer tube 30. In operation, when the second locking member 80 is in a first position shown in FIGS. 8A and 9A, the curvature of its lower concave surface 102 substantially corresponds to the curvature of the curved outer surface 94 of shaft 24, so that the outer tube 30 may be freely slid along the shaft 24. However, if the user presses the button 98 of the second locking member 76, the lower concave surface 102 will push against the shaft 24 in a second position shown in FIGS. 8B and 9B, pushing the shaft 24 against the first locking member 76 and preventing relative movement between the outer tube 30 and the shaft 24.

The locking members 76 and 80 are preferably made from a soft, lightweight and flexible material such as rubber, teflon or polyurethane. Although FIGS. 1–3 illustrate the locking members as being preferably located directly opposite each other at the portion of the outer tube 30 near the location where the flared bottom portion 32 begins, it will be appreciated by those skilled in the art that the locking members 76 and 80 can be provided anywhere along the length of the outer tube 30 without departing from the spirit and scope of the present invention. However, the locking members 76 and 80 should be positioned at locations where a user can conveniently carry out the operations described below. For example, the locking members 76 and 80 are preferably located substantially opposite each other because they are intended to be manipulated by both hands of the user.

The locking members 76 and 80 may be used in combination by a user to modify the configuration of the mop strands 22 for various cleaning operations. For example, the outer tube 30 and flared bottom portion 32 may be slid downwardly and twisted (if desired) along shaft 24, or the shaft 24 lifted up and twisted (if desired) with respect to the outer tube 30, until the bottom edges 110 of the flared bottom portion 32 abut against the annular shoulder 65 of the base 50. Thus, the annular shoulder 65 defines the extent to which the flared bottom portion 32 can extend downwardly. At this point, while holding the flared bottom portion 32 against the annular shoulder 65, the first locking member 76 may be rotated or twisted by about ninety degrees to assume the second position of FIGS. 8B and 9B, locking the flared bottom portion 32 in place at the base 50. In this position, the mop strands 22 hang loosely as shown in FIG. 1.

While advancing the outer tube 30 relative to the shaft 24, twisting either the shaft 24 or the outer tube 30, or both, during the advancing of one with respect to the other will cause the mop strands 22 to assume different configurations. Thus, the user can adjust the configuration of the mop strands 22 by (1) advancing the outer tube 30 relative to the shaft 24, or (2) twisting either the shaft 24 or the outer tube 30 during the advancement, or (3) twisting both the shaft 24 and the outer tube 30 during the advancement.

When it is desired to wring the mop strands 22 dry, the first locking member 76 is rotated again by about ninety degrees back to the first position to free the flared bottom portion 32 for relative movement along the shaft. The outer tube 30 and flared bottom portion 32 are then slid upwardly and twisted (if desired) along the shaft 24, or the shaft 24 pushed downwardly and twisted (if desired) with respect to the outer tube 30, until the mop strands 22 have been extended to their maximum. At this point, the outer tube 30 cannot be pulled upwardly any further. To wring the strands 22 dry, the outer tube 30 and its flared bottom portion 32 is rotated with respect to the shaft 24 so that the strands 22 are stretched and wrapped around the shaft 24 (see FIG. 3). This may be accomplished by rotating the outer tube 30 only while keeping the shaft 24 stationary, by rotating the shaft 24 only while keeping the outer tube 30 stationary, or by simultaneously rotating the shaft 24 and the outer tube 30 in opposite directions. Then, using a first hand to grip the outer tube 30, the user presses the button 98 of the second locking member 80 with a finger from this first hand to temporarily hold the outer tube 30 at this desired position with respect to the shaft 24 while simultaneously using the fingers of the other hand to twist the first locking member 76 by about ninety degrees to lock the outer tube 30 in this position along the shaft 24.

Thus, pressing the button 98 of the second locking member 80 engages the outer tube 30 with the shaft 24, so only one hand is needed to grip both the outer tube 30 and the shaft 24, thereby freeing the other hand to operate the first locking member 76 while maintaining the outer tube 30 at the desired location along the shaft 24. Otherwise, if the second locking member 80 was not provided, relative movement between the outer tube 30 and the shaft 24 would occur, making it difficult for the user to operate the first locking member 76. In such a situation, the user would need to set the mop base 50 on the floor, hold the outer tube 30 at the desired location along the shaft 24, and then operate the first locking member 76 very carefully without moving the position of the outer tube 30. This would be an undesirably inconvenient operation. The use of the second locking member 80 allows the user to accurately maintain the position of the outer tube 30 along the shaft 24 while operating the first locking member 76 even while holding the mop 20 in mid-air.

The mop strands 22 may also be configured in a bundled or ball-shaped manner, as shown in FIG. 2, which is effective in cleaning a variety of objects and surfaces, and in particular, hard spots. This configuration may be achieved by rotating the first locking member 76 back to the first position to release the outer tube 30, sliding and twisting (if desired) the outer tube 30 relative to the shaft 24 until the mop strands 22 assume the desired configuration, then repeating the operation described above with respect to the first and second locking members 76 and 80 to lock the outer tube 30 in the desired position along the shaft 24. Of course, the mop strands 22 may assume any desired configuration; the user only needs to adjust the position of the outer tube 30 along the shaft 24 to find the desired configuration.

In this regard, the second locking member 80 also performs two other functions. First, it temporarily holds the outer tube 30 at a position along the shaft 24 so that the user can see if this position provides the desired mop strand 22 configuration. If the desired configuration is not achieved, the user can easily release the second locking member 80 and try to find another position along the shaft 24 which would achieve the desired configuration. Thus, the second locking member 80 allows the user to conveniently adjust the position of the outer tube 30 along the shaft 24. Second, the user may use the second locking member 80 alone to hold the outer tube 30 at the desired position along the shaft 24 on a more permanent basis, without using the first locking member 76.

Thus, the first and second locking members 76 and 80 provide simple mechanisms which may be operated in combination in a manner that renders the mop 20 very convenient and easy to use. This allows the mop strands 22 to assume a variety of configurations that allow the mop 20 of the present invention to be used in cleaning a large variety of objects.

It will be appreciated by those skilled in the art that modifications can be made to the mop 20 of the present invention without departing from the spirit and scope of the present invention. By way of example only, and in no way intending to limit the alternatives that can be encompassed by the appended claims, (1) the ribs 36, and even the outer surface of the flared bottom portion 32, may be provided with engaging mechanisms other than the teeth 40; (2) the structure of the base 50 can be different; (3) the lower ends of the strands 22 and the tie member 68 can be retained in the base 50 by a mechanism other than the locking screw 64; and (4) gripping mechanisms other than the locking ring 90 may be provided to allow the user to rotate the first locking member 76.

While the description above refers to particular embodiments of the present invention, it will be understood that many modifications may be made without departing from the spirit thereof.

What is claimed is:

1. A mop comprising:

an elongated shaft having an upper portion and a lower portion;

a handle portion attached to the upper portion of the shaft;

a base non-rotatably secured to the lower portion of the shaft;

an outer tube slidably mounted on the shaft;

a plurality of mop strands having upper ends secured to a first annular tie member and lower ends secured to a second annular tie member, the first annular tie member secured to the outer tube and the second annular tie member secured to the base;

a first locking member movably mounted on the outer tube, the first locking member operably movable between a locked position wherein said first locking member lockingly engages the shaft to fix the tube to the shaft in a desired location along the shaft and an unlocked position wherein said first locking member does not engage the shaft, a second locking member movably mounted on the outer tube, the second locking member adapted to temporarily engage the outer tube to fix the tube to the shaft in the desired position along the shaft while the first locking member is operated to lockingly engage the shaft to fix the outer tube to the shaft at the desired location along the shaft.

2. The mop of claim 1, wherein the shaft further comprises a curved outer surface, and wherein the first locking member further comprises a lower concave surface terminating at two outer edges, the lower concave surface of the first locking member having substantially the same curvature as the curved outer surface of the shaft, wherein in said unlocked position, the lower concave surface of the first locking member corresponds to the curved outer surface of the shaft to allow the outer tube to be freely movable with respect to the shaft, and in said locked position in which the first locking member has been rotated so that the outer edges of the lower concave surface frictionally engage the shaft to prevent movement of the outer tube relative to the shaft.

3. The mop of claim 2, wherein the second locking member comprises a lower concave surface having substantially the same curvature as the curved outer surface of the shaft, and wherein the second locking member may be pushed against the shaft to prevent movement of the outer tube relative to the shaft.

4. The mop of claim 3, wherein the outer tube further comprises a flared bottom portion, the flared bottom portion having a lower edge, the flared bottom portion having a circumferential dimension that is largest at the lower edge.

5. The mop of claim 4, wherein the first annular tie member has a circumferential dimension that is smaller than the largest circumferential diameter of the flared bottom portion, and wherein the upper ends of the mop strands and the first tie member are engaged by the flared bottom portion.

6. The mop of claim 5, wherein the flared bottom portion comprises a plurality of ribs and at least one tooth provided along each of the ribs, wherein the at least one tooth is adapted to engage the upper ends of the mop strands and the first annular tie member.

7. The mop of claim 2, wherein the first locking member is rotated by about ninety degrees to cause the outer edges of the lower concave surface to frictionally engage the shaft.

8. The mop of claim 7, wherein the first locking member further comprises a hollow button attached to the lower concave surface, the button comprising opposing openings adapted to receive a locking ring, wherein the locking ring is adapted to be gripped by a user for rotating the first locking member.

9. The mop of claim 3, wherein the base comprises a bore, and the bore comprises a plurality of threads, the mop further comprising a locking screw having a plurality of threads and an annular flange, wherein the lower ends of the mop strands and the second annular tie member are adapted to be secured inside the bore by engaging the threads of the locking screw and the bore and having the annular flange support the lower ends of the mop strands and the second annular tie member.

10. The mop of claim 3, wherein the second locking member further comprises a button attached to the lower concave surface of the second locking member, the button adapted to be pressed by a user to cause the lower concave surface of the second locking member to contact the curved outer surface of the shaft.

11. The mop of claim 3, wherein the first and second locking members are positioned substantially opposite each other along the outer tube.

12. The mop of claim 1, wherein the outer tube comprises a curved inside surface, and wherein the first locking member further comprises an upper covex surface terminating at two outer edges, the upper convex surface of the first locking member having substantially the same curvature as the curved inside surface of the outer tube, and wherein in a first position, the upper convex surface of the first locking member corresponds to the curved inside surface of the outer tube to allow the outer tube to be freely movable with respect to the shaft, and in a second position in which the first locking member has been rotated so that the outer edges of the upper convex surface frictionally engage the inside surface of the outer tube to prevent movement of the outer tube relative to the shaft.

13. A mop comprising:

an elongated shaft having a curved outer surface, an upper portion and a lower portion;

a handle portion attached to the upper portion of the shaft;

a base non-rotatably secured to the lower portion of the shaft;

an outer tube slidably mounted on the shaft, the outer tube comprising a curved inside surface, a first opening and a second opening;

a plurality of mop strands having upper ends secured to a first annular tie member and lower ends secured to a second annular tie member, the first annular tie member secured to the outer tube and the second annular tie member secured to the base;

a first locking member extending through and movably mounted in the first opening of the outer tube, the first locking member comprising a lower concave surface terminating at two outer edges, the lower concave surface of the first locking member having substantially the same curvature as the curved outer surface of the shaft, the first locking member further comprising an upper convex surface terminating at two outer edges, the upper convex surface of the first locking member having substantially the same curvature as the curved inside surface of the outer tube;

wherein the first locking member is adapted to assume two positions relative to the shaft, wherein in a first position, the lower concave surface of the first locking member corresponds to the curved outer surface of the shaft and the upper convex surface of the first locking member corresponds to the curved inside surface of the outer tube to allow the outer tube to be freely movable with respect to the shaft, and in a second position in which the first locking member has been rotated so that the outer edges of the lower concave surface frictionally engage the shaft and the outer edges of the upper convex surface frictionally engage the inside surface of the outer tube to prevent movement of the outer tube relative to the shaft; and a second locking member extending through and movably mounted in the second opening of the outer tube, wherein the second locking member may be pushed against the shaft to prevent movement of the outer tube relative to the shaft;

wherein the second locking member is adapted for temporarily holding the outer tube in a desired position along the shaft while the first locking member is rotated to the second position frictionally engage the shaft.

14. The mop of claim 13, wherein the first and second locking members are positioned substantially opposite each other along the outer tube.

15. The mop of claim 13, wherein the second locking member comprises a lower concave surface having substantially the same curvature as the curved outer surface of the shaft.

* * * * *